United States Patent [19]

Ogawa

[11] Patent Number: 4,693,470

[45] Date of Patent: Sep. 15, 1987

[54] AUXILIARY INSTRUMENT FOR STRETCHING AND SOFTENING EXERCISES

[76] Inventor: Takashi Ogawa, 97 Imolima-1 chome, Gifu-shi, Gifu 500, Japan

[21] Appl. No.: 919,599

[22] PCT Filed: Mar. 31, 1983

[86] PCT No.: PCT/JP83/00103

§ 371 Date: Jun. 26, 1984

§ 102(e) Date: Jun. 26, 1984

[87] PCT Pub. No.: WO84/01723

PCT Pub. Date: May 10, 1984

Related U.S. Application Data

[63] Continuation of Ser. No. 626,870, Jun. 26, 1984, abandoned.

[30] Foreign Application Priority Data

Oct. 27, 1982 [JP] Japan ..... 57-162602
Dec. 21, 1982 [JP] Japan ..... 57-225464

[51] Int. Cl.[4] ..... A63B 23/04
[52] U.S. Cl. ..... 272/96; 272/93
[58] Field of Search ..... 272/70, 69, 96, 93, 272/144, 145, DIG. 9, DIG. 10, 105; 248/454, 455, 456; 297/238, 239

[56] References Cited

U.S. PATENT DOCUMENTS

| | | | |
|---|---|---|---|
| 2,760,774 | 8/1956 | Perez | 272/96 |
| 2,830,816 | 4/1958 | Uhl | 272/96 |
| 3,297,320 | 1/1967 | DiBenedetto | 272/DIG. 10 |
| 3,381,928 | 5/1968 | White | 248/455 |
| 3,653,715 | 4/1972 | Drabert et al. | 272/69 |
| 4,422,635 | 12/1983 | Herod et al. | 272/96 |
| 4,429,868 | 2/1984 | LeBlanc et al. | 272/144 X |

FOREIGN PATENT DOCUMENTS

| | | | |
|---|---|---|---|
| 52-59 | 1/1977 | Japan . | |
| 52-131166 | 10/1977 | Japan . | |
| 57-54431 | 3/1982 | Japan . | |
| 0316457 | 10/1971 | U.S.S.R. | 272/105 |

*Primary Examiner*—Robert E. Bagwill
*Assistant Examiner*—Kathleen D'Arrigo
*Attorney, Agent, or Firm*—Pahl, Lorusso & Loud

[57] ABSTRACT

The auxiliary instrument for stretching and softening exercises is to be provided for stretching and softening exercises (stretching exercises) and particularly for exercises of stretching Achilles' tendons and calves and can be used also as a treading health instrument.

That is to say, this invention is an auxiliary instrument for stretching and softening exercises comprising a supporting base (1), a treading base (2) hinged at one end to this supporting base so as to be free to rise and fall and to open and close, an angle adjusting member (3) interposed between the supporting base (1) and treading base (2) so as to keep the opening and closing angle between them at a predetermined angle and a stopper (4) erected in the rear of the treading base (2) or supporting base (1), a semi-cylindrical member (21) formed to be of a curved surface corresponding to the plantar arches of feet being fitted on the upper surface of the above mentioned treading base (2).

Therefore, by varying the position of the angle adjusting member (3), the angle between the supporting base (1) and treading base (2) can be varied in response to the softness of the body. This auxiliary instrument is convenient for stretching and softening exercises. When the angle adjusting member (3) is removed and the treading base (2) is set horizontally, the auxiliary instrument will be able to be used as a treading health instrument.

1 Claim, 10 Drawing Figures

AUXILIARY INSTRUMENT FOR STRETCHING AND SOFTENING EXERCISES

This application is a continuation of Ser. No. 626,870, filed June 26, 1984, now abandoned.

TECHNICAL FIELD

This invention relates to improvements of an auxiliary instrument for stretching and softening exercises.

BACKGROUND TECHNIQUE

The stretching and softening exercise is an exercise to stretch and soften muscles and tendons by gradually adding a reasonable proper force to the muscles and tendons of various parts of a human body to stretch and relax them and is a so-called stretching exercise.

There are such effects that, if this stretching exercise is carried out as a preparatory exercise before playing a sport, such unexpected injury as a muscle separation in the sport will be able to be prevented and, if it is carried out as an adjusting exercise after the end of the sport, the excitation of the muscles and tendons severely used in the sport will be tranquilized and the fatique will be quickly removed.

Further, it is endorsed by the health and physical education theory that such stretching exercise makes the body softer, keeps health and serves for beauty. Together with its handiness, the stretching exercise has recently come to be popular not only in the sport circle but also generally.

There has been no auxiliary instrument for stretching and softening exercises which have been considered to be exercises using no instrument.

The present invention is made to further elevate the effects of such stretching and softening exercise and is to provide an auxiliary instrument for stretching and softening exercises serving for exercises for stretching particularly the Achilles' tendons and calves.

DISCLOSURE OF THE INVENTION

The auxiliary instrument for stretching and softening exercises according of the present invention comprises a supporting base 1, a treading base 2 hinged at one end to this supporting base so as to be free to rise and fall and to open and close, an angle adjusting member 3 interposed between the supporting base 1 and treading base 2 so as to keep the opening and closing angle between them at a predetermined angle and a stopper 4 erected in the rear of the treading base 2 or supporting base 1. The auxiliary instrument may also comprise, a semi-cylindrical member 21 formed to be of a curved surface corresponding to the plantar arches of feet being fitted on the upper surface of the above mentioned treading base 2. The supporting base 1 may be provided with a carrying handle 5. recess 11 for containing the angle adjusting member 3 is made on the upper surface of the above mentioned supporting base 1. The connecting part 13 of the treading base 2 and the erecting part of the stopper 4 may be separated from each other to provide a heel space part on the supporting base 1.

The invention shall be described in the following with reference to the drawings.

FIG. 1 is a view showing that the supporting base 1 and treading base 2 are opened from each other with the hinged connecting part 13 as a fulcrum and the angle adjusting member 3 is inserted between the supporting base 1 and treading base 2 so as to secure the opening between the supporting base 1 and treading base 2. When a person stands on this treading base 2 with the tiptoes directed forward, that is, in the higher direction, the Achilles' tendons, calf muscles and flatfish muscles will be able to be reasonably stretched.

Further, when the person exercises to bend forward as in FIG. 1 from the standing state, such muscle parts as the muscles in the rear of the thighs, back muscle, muscle in the rear of the neck, Achilles' tendons, calf muscles and flatfish muscles will be stretched. Therefore, there are such stretching effects as the prevention of waist pain, rehabilitation of a person suffering from waist pain, recovery from fatigue by a work in a waist bending posture, prevention of the spinal curvature, cure of the spinal curvature and rehabilitation of a person having had the Achilles' tendon broken. Further, by taking such forward bent posture, anyone can easily measure the forward bent softness.

The angle between the supporting base 1 and treading base 2 must be varied in response to the softness of the body of the user of the auxiliary instrument for stretching and softening exercises. That is to say, when a person of a soft body is to use it, unless the inclination of the treading base 2 is made considerably sharp, the effect of stretching the Achilles' tendons and calf muscles will not be high. On the other hand, when a person of a hard body uses it with the inclination made sharp, an unreasonable force will be applied to the Achilles' tendons and calf muscles and, as a result, the Achilles' tendons and calf muscles will be likely to be broken quite contrary to the object of the stretching exercise to prevent injury.

In the case that the same person uses this auxiliary instrument for stretching and softening exercises, at the beginning of the exercise, the treading base 2 of a low inclination should be used to accustom the body and, when the muscles have been relaxed to some extent, the treading base 2 of a sharp inclination should be used so as to be able to further stretch the Achilles' tendons and others and to elevate the effects of the stretching exercise. Therefore, the angle between the supporting base 1 and treading base 2 must be able to be freely varied. For that purpose, the treading base 2 may be hinged at one end to the supporting base 1 with hinges or self-hinges.

The predetermined angle set between the supporting base 1 and treading base 2 must be kept constant even if a person mounts on the treading base. That is to say, if the angle fluctuates in the use, the stability will be so short that the user will be likely to be unbalanced to stumble. It is dangerous. Therefore, the angle adjusting member 3 is interposed between the supporting base 1 and treading base 2 to secure the opening and closing angle between the supporting base 1 and treading base 2. This angle adjusting member 3 is inserted between the supporting base 1 and treading base 2 so as to set the opening and closing angle between the supporting base 1 and treading base 2 by moving its location.

Therefore, even when the angle adjusting member 3 is merely inserted between the supporting base 1 and treading base 2, it will be effective anyhow. However, when a person mounts on the treading base 2 as in FIG. 1 and performs stretching and softening exercises, the location of the angle adjusting member 3 will be likely to deviate so as to be dangerous. It is desired to prevent the deviation of the location of the angle adjusting member 3.

In consideration of the case that a person stands on this auxiliary instrument for stretching and softening exercises and performs a stretching exercise, some slip stopper is required so that the person may not be unbalanced on the treading base 2 inclined from the horizontal surface. Provided for that purpose is the stopper 4 which will contact the vertical parts in the rear of the heels, that is, the skins on the outer surfaces of the Achilles' muscles so as to support the feet from the rear to prevent them from slipping.

This stopper 4 may be provided to vertically project in the rear of the supporting base 1 or may be provided to project so as to be inclined somewhat forward in the rear of the treading base 2. The stopper 4 is inclined somewhat forward in being provided to project on the treading base 2 so that, in case the treading base 2 is inclined from the horizontal surface, the stopper 4 will be substantially vertical to the horizontal surface, because, in case a person performs a stretching exercise with this auxiliary instrument for stretching and softening exercises, the principle of the posture will be a vertically standing state and therefore the stopper 4 to serve as a slip stopper will have to be also substantially vertical to the horizontal surface.

The invention according to claim 5 shown in FIGS. 2 and 3 has a heel space part 12 formed between the stopper 4 and the connecting part 13 of the treading base. This heel space part 12 is a part on which heels will be mounted when the auxiliary instrument for stretching and softening exercises is used. This heel space part 12 is to prevent the heels from being held between the treading base 2 and stopper 4 when the instrument is to be used with the treading base 2 sharply inclined. That is to say, in case the heel space part 12 is small or is not provided, if the instrument is used with the treading base 2 sharply inclined, the heels will be pressed into contact with the stopper 4 and will be pushed into the acute angle space made by the treading base 2 and stopper 4 to cause pain to the heels. It is to prevent such pain.

It is desirable that the auxiliary instrument for stretching and softening exercises will be able to be compactly kept when it is not used. For this purpose, the invention according to claim 4 is provided on the upper surface of the supporting base 1 with a recess 11 for containing the angle adjusting member 3. The angle adjusting member 3 may be contained in this recess 11, the treading base 2 may be horizontally closed to the supporting base 1 and a lid may be applied.

It is desirable that the auxiliary instrument for stretching and softening exercises as compactly kept is convenient to carry. For this purpose, the invention according to claim 3 is provided on the supporting base 1 with a carrying handle 5 which can be folded when the instrument is not used.

The treading base 2 is so formed as to be able to be used also for others than stretching and softening exercises. In the invention according to claim 2, the treading base 2 can be used for a health instrument. For this purpose, a semi-cylindrical member 21 formed to be of a curved surface corresponding to the plantar arches of feet is provided on the upper surface of the treading base 2. When it is to be used for a treading health instrument, it should be used with the treading base 2 kept horizontal, that is to say, with the auxiliary instrument for stretching and softening exercises kept folded so that, when the user stands and treads on the treading base 2, the semi-cylindrical member 21 may contact the plantar arches.

By the way, as shown in FIG. 2 or 4, this semi-cylindrical member 21 may be so formed as to be removably fitted to the treading base 2 and to be able to vary the semi-cylindrical member 21 fitting direction to be vertical or horizontal to the stopper 4. That is to say, two dovetail grooves 28 are formed as crossed with each other on the upper surface of the treading base and the engaging part 29 of the seim-cylindrical member 21 is engaged with one of the dovetail grooves 28.

In such case, if this semi-cylindrical member 21 is arranged and fixed in the direction vertical to the stopper 4 as shown in FIG. 4, when the user stands on the treading base 2, both feet will be guided parallelly with the semi-cylindrical member 21 so that the user may perform a stretching exercise in a right posture. Further, if this semi-cylindrical member 21 is arranged and fixed in the direction parallel with the stopper 4 as shown in FIG. 5, when the user stands on the treading base 1, this semi-cylindrical member 21 will contact the plantar arches of both feet, therefore the soles of the feet will be lifted, the same action as sharply inclining the treading base 2 will be obtained, further the plantar arches will be arcuately lifted with the tiptoes and heels of the feet as fulcra and an exercise of stretching the insteps of the feet will be made.

When the angle adjusting member 3 is removed from between the supporting base 1 and treading base 2, the treading base 2 is mounted horizontally on the supporting base 1 and an exercise of treading this semi-cylindrical member 21 is made, the instrument will be able to be used as a treading health instrument as described above.

The auxiliary instrument for stretching and softening exercises according to the present invention is formed as in the above and has the below described advantages.

This auxiliary instrument for stretching and softening exercises is to provide the treading base 2 of any angle of inclination in response to the softness of the body of the user. By using the angle adjusting member 3, the angle of inclination can be maintained stably without any defect in the strength. Further, as the feet are prevented by the stopper 4 from slipping, the stretching exercise can be easily made.

Further, this auxiliary instrument for stretching and softening exercises is comparatively small, can be folded when not used and needs no too large space. The invention according to claim 3 is provided with the carrying handle 5, is therefore convenient to carry and can be used handily anywhere in the daily life.

Further, this auxiliary instrument for stretching and softening exercises is provided with such semi-cylindrical member 21 as in the invention according to claim 2 and can be therefore used as a health instrument when folded. As the invention according to claim 5 is provided with the heel space part 12, even in case it is used with the treading base 2 sharply inclined, the rear parts of the heels will not be pressed into contact with the stopper 4, no external force will be applied to the heels and therefore the stretching exercise will be able to be pleasantly made. Anyone can measure the forward bent softness with this instrument.

BRIEF DESCRIPTION OF THE DRAWINGS

FIG. 1 is a perspective view in the using state.

FIG. 2 is a perspective view of the whole.

FIG. 3 is a side view in the using state.

FIG. 4 is a perspective view of the whole.

FIG. 5 is a sectioned side view in the using state.

FIGS. 6 to 10 show an embodiment.

FIG. 6 is a partly sectioned perspective view of the whole.

FIG. 7 is a perspective view of the whole as seen from the bottom.

FIG. 8 is a perspective view of the whole as disassembled.

FIG. 9 is a perspective view in the folded state.

FIG. 10 is a perspective view of an angle adjusting member.

BEST FORM TO WORK THE INVENTION

Figure 1:
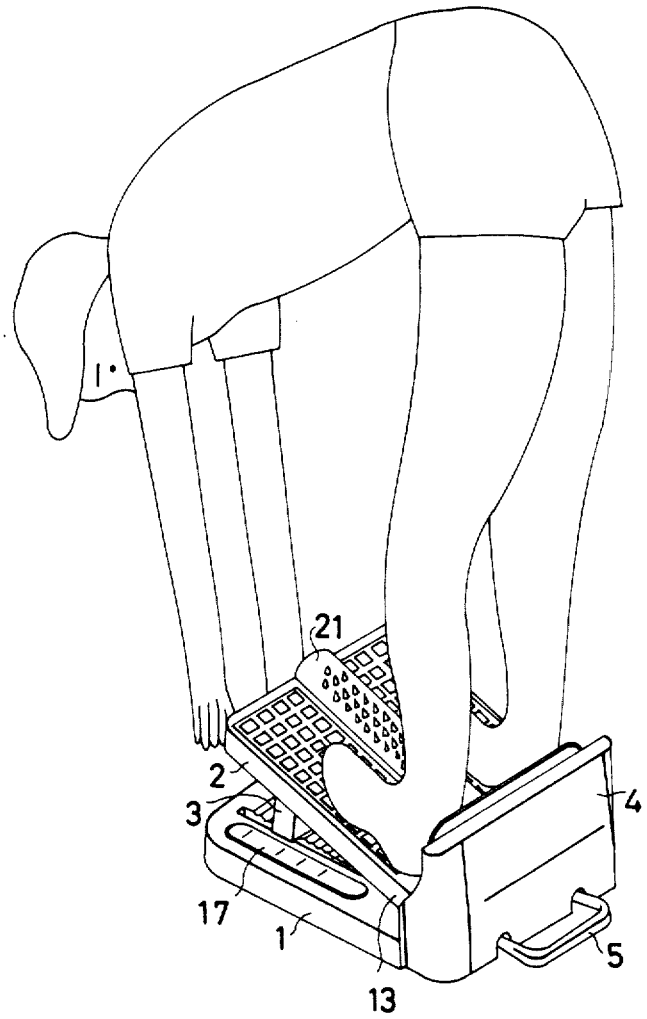
FIGS. 1 to 10 are to illustrate an auxiliary instrument for stretching and softening exercises according to the present invention.

FIGS. 6 to 10 show an embodiment of the present invention.

This auxiliary instrument for stretching and softening exercises is of such size that a person can mount on the treading base and can easily take a forward bent or sidewise bent posture. The supporting base 1, treading base 2, angle adjusting member 3 and stopper 4 are molded of plastics to be hollow bodies of ribs and plates. The supporting base 1 and stopper 4 are integral with each other. Four engaging windows 14 are opened on the front surface of the base end of the stopper 4 erected at the rear end of the supporting base 1 to form connecting parts 13 together with engaging projections 22 provided to project at the rear end of the treading base so as to hinge the treading base 2 and supporting base to each other.

That is to say, the engaging projections 22 are to be inserted into the respective engaging windows 14 so as to be axes for the opening and closing rotation in case the treading base 2 is used or folded and the cylindrical axis parts 23 at the tips of the respective engaging projections 22 are made eccentric upward so as to be prevented from being pulled out. By the way, the lower parts of the respective axis parts 23 are cut to be flat surfaces so that the engaging projections 22 may be inserted into the respective engaging windows 14. Wedge-shaped projections 24 for preventing the engaging projections from being pulled out are provided outside the engaging projections 22 at both ends among the four engaging projections 22 so as to prevent the engaging projections 22 inserted in the respective engaging windows 14 from being pulled out.

Figure 8:
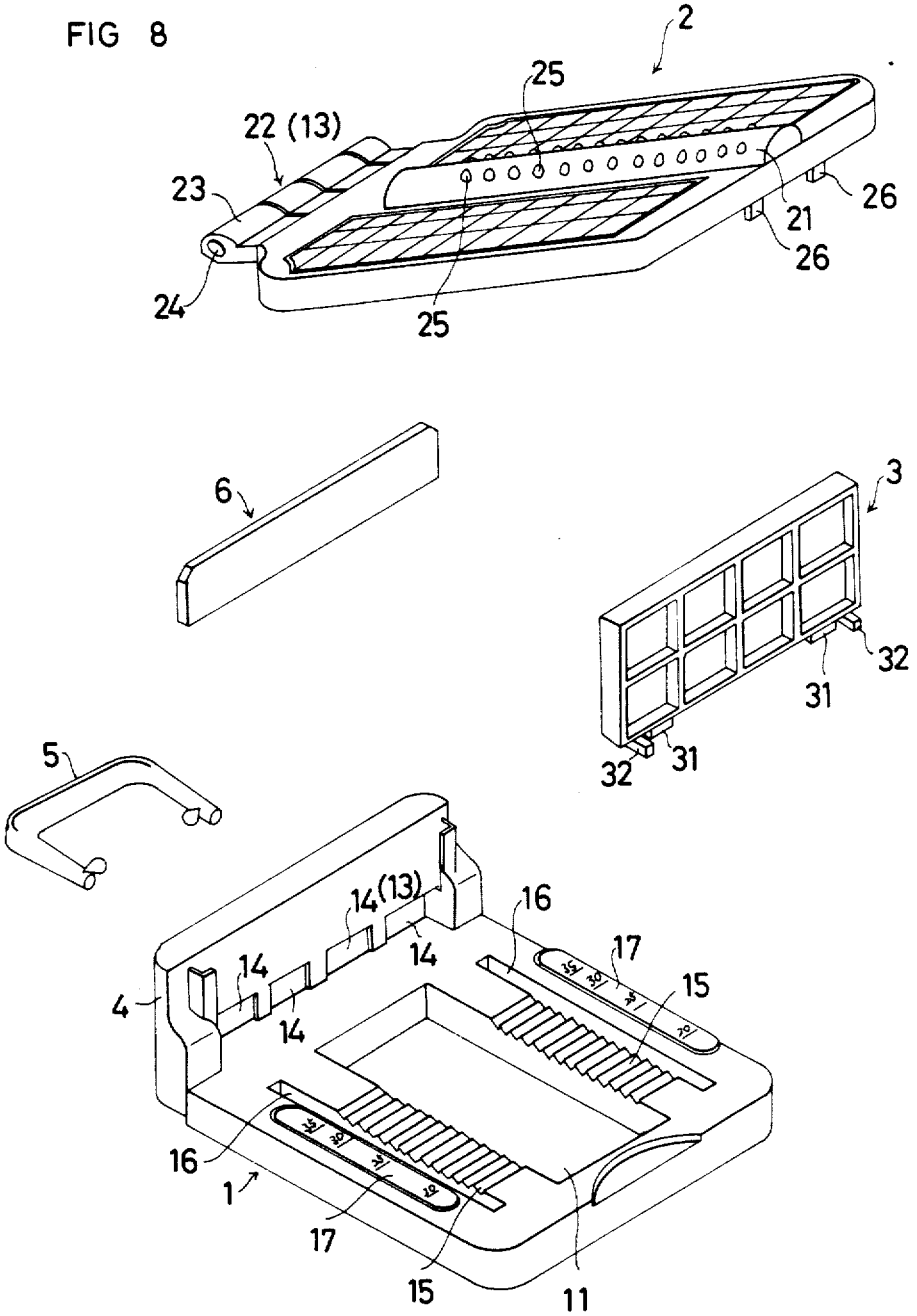
Figure 9:
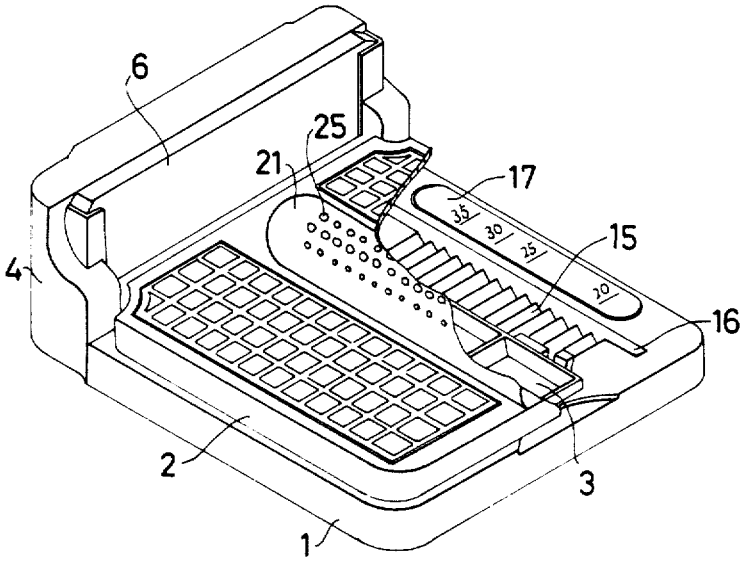
Figure 10:
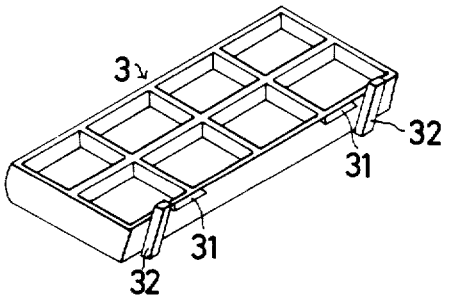

The angle adjusting member 3 interposed between the supporting base 1 and treading base 2 is provided with projections chisel-shaped in the cross-section respectively on both sides of the lower part as shown in FIG. 10 so as to prevent the deviation of the position. Sets of recesses 15 corresponding to this set of projections 31 are provided in parallel with the stopper 4 on the upper surface of the supporting base 1 as shown in FIG. 8. These recesses 15 are formed to be saw blade-shaped in the cross-section so as to be vertical on the stopper 4 side and inclined on the side reverse to the stopper 4. By engaging these sets of projections 31 and recesses 15 with each other, the angle adjusting member 3 is positioned on the supporting base 1 so as to be prevented from being deviated from the position.

A plurality of sets of recesses 15 are successively arranged to be saw-shaped on the supporting base 1. Therefore, by varying the combination of the projections 31 of the angle adjusting member 3 with the plurality of sets of recesses 15 arranged in two rows, the distance from the position of the angle adjusting member 3 to the connecting parts 13 can be varied to adjust the inclination of the treading base 2 so as to be low or sharp. Guide grooves 16 are provided respectively outside the two rows of the plurality of recesses 15 and are to guide in sliding contact projections 32 provided respectively outside the set of projections 31 of the angle adjusting member 3. That is to say, to vary the inclination of the treading base 2, the angle adjusting member 3 is lifted a little, the projections 31 and recesses 15 are disengaged with each other and the projections 32 of the angle adjusting member 3 are made to slide in the respective guide grooves to guide the angle adjusting member 3 to any desired recesses 15.

By the way, angle scales 17 are provided respectively outside the guide grooves 16 so as to indicate the relation of the position of the angle adjusting member 3 with the angle of inclination of the treading base for the convenience of the adjustment to any desired angle of inclination.

Rubber pieces 17 are embedded in the parts to be in contact with the angle adjusting member 3 on the bottom surface of the treading base 2 so that, while the instrument is being used, the treading base 2 will not slip in the parts in contact with the angle adjusting member 3 to stumble the angle adjusting member 3.

Further, a recess 11 is provided intermediately between the two rows of the plurality of sets of recesses 15 on the upper surface of this supporting base 1 and is formed to be of any required size and shape to contain the angle adjusting member 3 as shown in FIG. 10. By the way, locking lugs 26 provided to hang in the front part (on the other side of the engaging projections) of the treading base 2 can be locked with this recess 11 so that, when the treading base 2 is closed and folded, unless a force is applied, the treading base 2 and supporting base 1 will not be opened.

On the other hand, the carrying handle 5 is pivoted so as to be free to open and close just below the stopper 4 on the bottom surface of the supporting base 1. This carrying handle 5 is opened to project out of the outer surface of the stopper 4 so as to be used and is closed to be embedded in the supporting base 1 so as not to be used.

Slip stoppers 18 made of rubber are embedded respectively in the corners on the other side of the stopper 4 on the bottom surface of the supporting base 1 so that the supporting base 1 will not slip on the floor surface while the instrument is being used.

The semi-cylindrical member 21 at right angles with the stopper 4 is provided on the upper surface of the treading base 2 as shown in the drawings, is formed to be semi-circular in the cross-section and to have such curved surface as corresponds to the plantar arches of feet and is provided with many small button-shaped projections 25 on the upper surface.

When the user stands on the treading base 2 as shown in FIG. 1, both feet will be guided parallelly with this semi-cylindrical member 21 and the stretching exercise will be made with a right posture.

When the angle adjusting member 3 is removed from between the supporting base 1 and treading base 2, the treading base 2 is mounted horizontally on the supporting base 1 and the exercise of treading this semi-cylindrical member 21 is made, a treading health exercise called bamboo treading will be made. In such case, as many small button-shaped projections 25 are arranged on the upper surface of the semi-cylindrical member 21, these small projections 25 will more effectively sting particularly the plantar arches of the soles of feet.

Sectional joint patterns are cut on the upper surface of the treading base 2 so as to prevent the user from slipping when he stands on the inclined treading base 2. Further, a protective pad 6 made of rubber is pasted to the part to be in contact with the heels of feet on the inside wall of the stopper 4 for preventing slipping so as to protect the heels.

Figure 2:
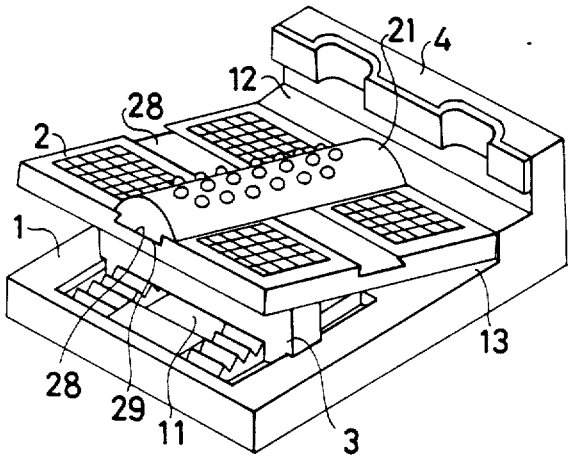
Figure 3:
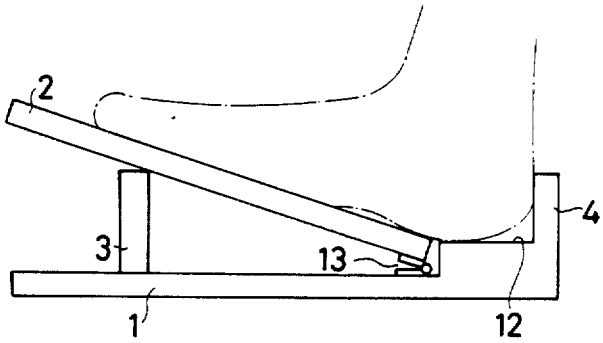
Figure 4:
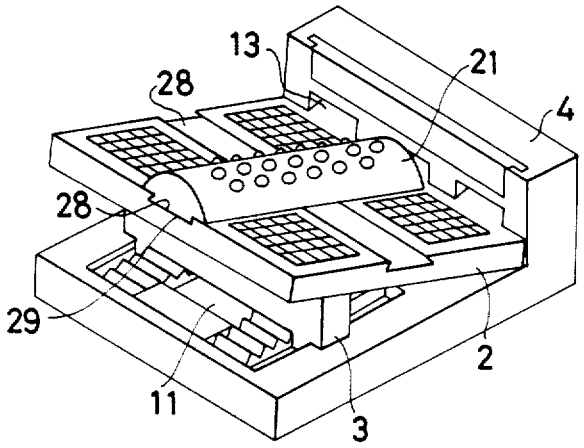
Figure 5:
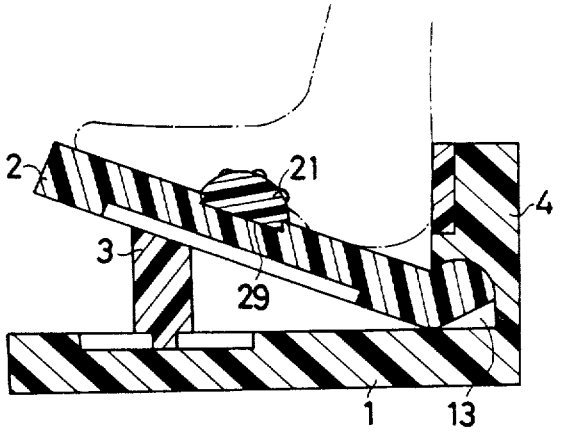
Figure 6:
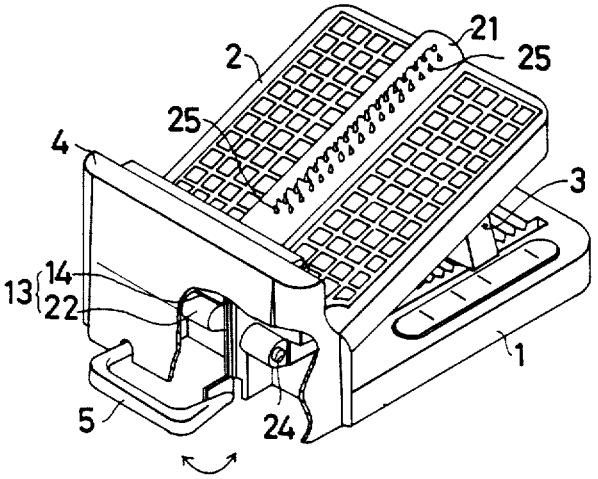
Figure 7:
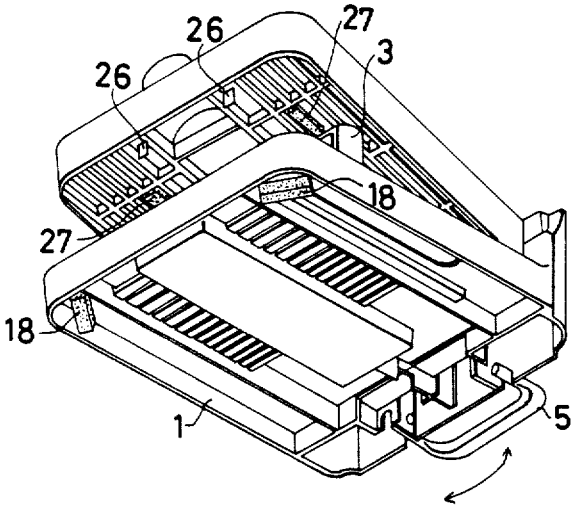

By the way, when this auxiliary instrument for stretching and softening exercises is not to be used, as shown in FIG. 2, the angle adjusting member 3 will be able to be contained in the recess 11 in the supporting base 1 and the treading base 2 will be able to be folded. In such case, this auxiliary instrument for stretching and softening exercises will be a treading health instrument as described above.

What is claimed is:

1. An auxiliary instrument for stretching and softening exercises comprising a supporting base positionable on a horizontal surface, a single treading base wide enough to completely support both of the user's feet having a flat top surface on which a user stands with a user's feet being supported by said surface, said treading base being hinged at one end to said supporting base so as to be free to rotate between a closed position and several locked open positions relative to said supporting base, an angle adjusting member interposed between said supporting base and treading base to keep said treading base at a selected one of said several open positions and a stopper erected immediately adjacent said treading base in the region where said treading base is hinged to said supporting base said stopper adapted to engage the user's heels so that the feet rest entirely on said treading base.

* * * * *

UNITED STATES PATENT AND TRADEMARK OFFICE

CERTIFICATE OF CORRECTION

PATENT NO. : 4,693,470

DATED : September 15, 1987

INVENTOR(S) : Takashi Ogawa

It is certified that error appears in the above—identified patent and that said Letters Patent is hereby corrected as shown below:

On the Title Page, Item [76]

In the inventor's address, "Imolima" should be --Imojima--.

Signed and Sealed this

Twenty-eighth Day of June, 1988

*Attest:*

*Attesting Officer*

DONALD J. QUIGG

*Commissioner of Patents and Trademarks*